US005460782A

United States Patent [19]

Coleman et al.

[11] Patent Number: 5,460,782

[45] Date of Patent: Oct. 24, 1995

[54] AUTOMATIC FILLING MICROPIPETTE WITH DISPENSING MEANS

[75] Inventors: Charles M. Coleman, Pittsburgh; William Kendrick, Doylestown, both of Pa.

[73] Assignee: Safe-Tec Clinical Products, Inc., Pittsburgh, Pa.

[21] Appl. No.: 276,194

[22] Filed: Jul. 18, 1994

[51] Int. Cl.[6] ..... B01L 3/02

[52] U.S. Cl. ..... 422/100; 422/99; 73/864.02; 73/864.11; 73/864.16; 128/760; 436/180

[58] Field of Search ..... 422/99, 100; 73/864.02, 73/864.11, 864.16; 222/206, 210, 249; 436/174, 180, 810; 128/760, 765, 766, 767; 604/187, 34

[56] References Cited

U.S. PATENT DOCUMENTS

| | | | |
|---|---|---|---|
| 2,398,737 | 4/1946 | Elliot et al. | 422/100 X |
| 3,406,573 | 10/1968 | Burke | 73/864.02 |
| 3,525,264 | 8/1970 | Nieglos et al. | 73/864.11 |
| 3,741,732 | 6/1973 | Stanfield | 73/425.4 |
| 3,783,696 | 1/1974 | Coleman | 73/425.4 |
| 3,834,241 | 9/1974 | Garren et al. | 73/864.11 |
| 3,952,599 | 4/1976 | Ayres | 73/864.02 |
| 3,958,045 | 5/1976 | Coleman | 427/230 |
| 4,104,025 | 8/1978 | Retzer | 23/230 R |
| 4,142,668 | 3/1979 | Lee | 422/100 |
| 4,299,795 | 11/1981 | Bates | 422/100 X |
| 4,314,570 | 2/1982 | Sarstedt | 128/763 |
| 4,361,155 | 11/1982 | Anastasio | 128/736 |
| 4,426,451 | 1/1984 | Columbus | 436/518 |
| 4,563,104 | 1/1986 | Saint-Amand | 401/139 |
| 4,900,515 | 2/1990 | Xalabarder-Miramanda | 422/100 |
| 5,054,498 | 10/1991 | Melet | 128/736 |
| 5,059,398 | 10/1991 | Kenney | 422/100 |
| 5,063,025 | 11/1991 | Ito | 422/100 |
| 5,065,768 | 11/1991 | Coleman et al. | 128/760 |
| 5,104,625 | 4/1992 | Kenney | 422/100 |
| 5,203,825 | 4/1993 | Haynes et al. | 73/864.02 |
| 5,230,864 | 7/1993 | Columbus | 422/100 |

*Primary Examiner*—James C. Housel
*Assistant Examiner*—Long V. Le
*Attorney, Agent, or Firm*—Buchanan Ingersoll; Lynn J. Alstadt

[57] ABSTRACT

An automatic filling micropipette is formed from a tubular body having an open end, and being closed or having a piston at an opposite end. The tubular body is sized to permit liquid to flow into the tubular body by capillary action. An aperture is provided in the sidewall, the aperture having a diameter smaller than the diameter of the open end.

18 Claims, 1 Drawing Sheet

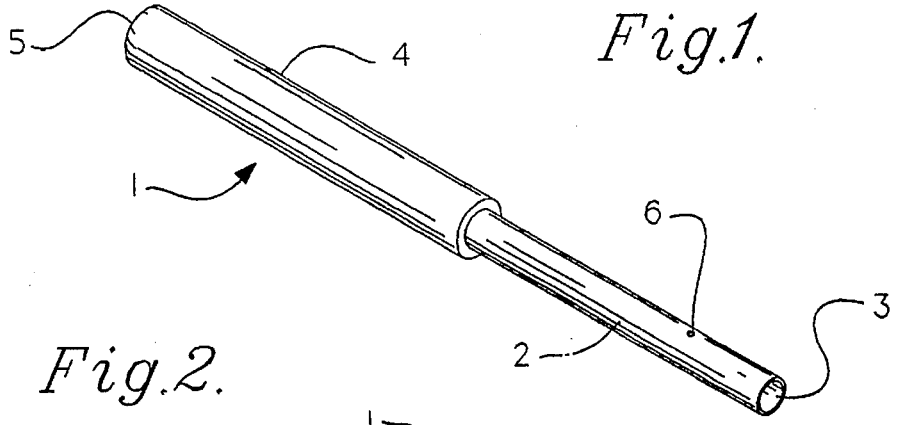
Fig.1.
Fig.2.
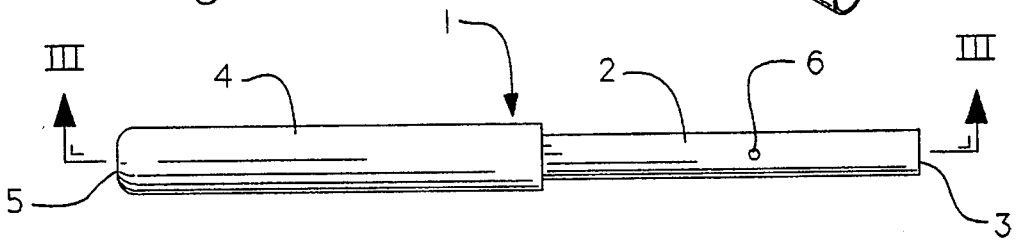
Fig.3.
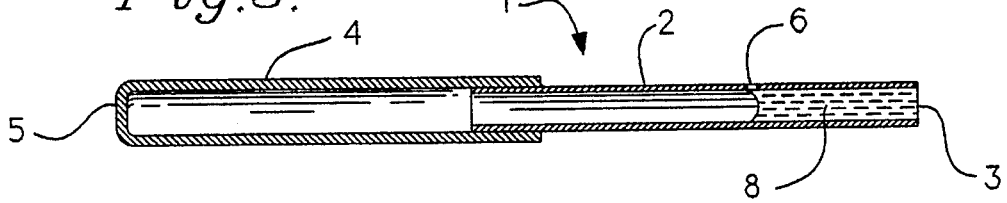
Fig.4.
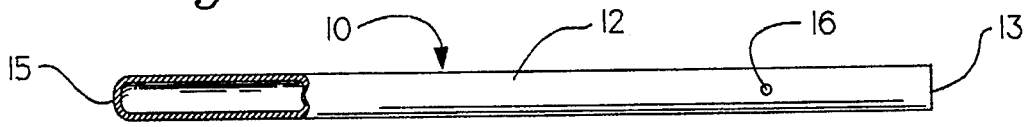
Fig.5.
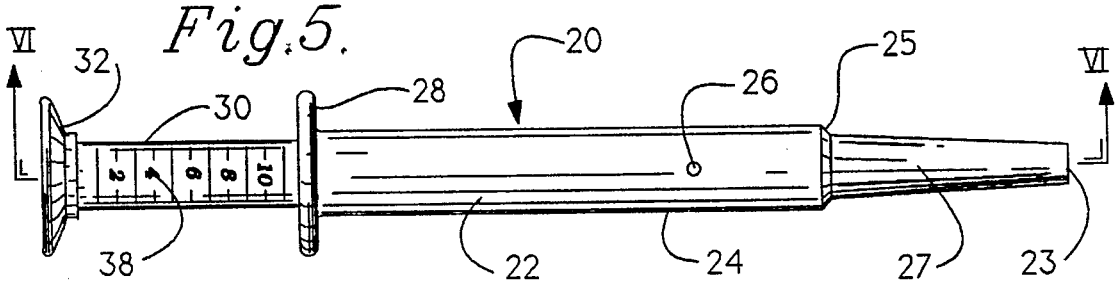
Fig.6.
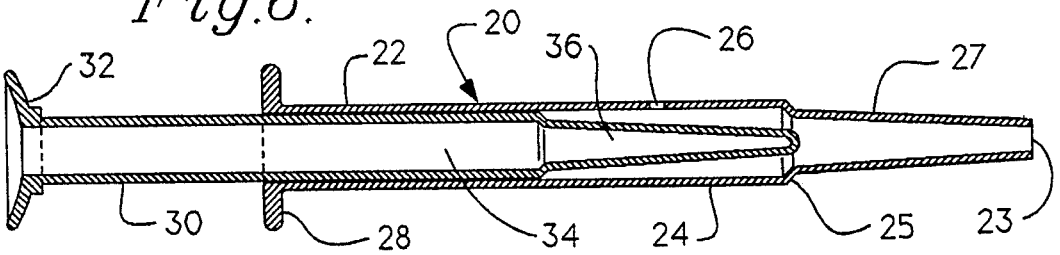

AUTOMATIC FILLING MICROPIPETTE WITH DISPENSING MEANS

FIELD OF THE INVENTION

The invention relates to a micropipette for collection and subsequent dispensing of a fluid.

BACKGROUND OF THE INVENTION

Pipettes and capillary tubes have long been used to collect and dispense fluids. These devices are particularly useful for collecting blood samples.

Perhaps the most simple type of capillary tube and micropipette is simply a glass or hydrophilic plastic tube open at both ends. One end of the tube is placed against a incision, blood flows into the tube from the incision by capillary action. Upon collection of the desired quantity of blood one can cap the end of the tube opposite the collection end.

It has been proposed to provide a unitary, blow-molded, plastic capillary tube with a flexible bulb blown at the proximate end of the capillary tube. To dispense the blood from the tube one simply squeezes the bulb. This technique has several shortcomings. First, it is difficult to dispense precise amounts of fluid from the pipette using the bulb. Second, in order to collect blood into the capillary tube, the user must first squeeze the bulb, then place the distal end of the tube against the incision and allow the bulb to expand. This technique draws air as well as blood into the tube. Consequently, bubbles are frequently interspersed with the collected blood. When the blood is then dispensed from the tube, air bubbles may be ejected with the blood. Some blood tests are conducted by placing droplets of blood on a reagent strip. If the blood is ejected with air bubbles, insufficient and poorly reproducible quantities of blood are deposited onto the strip providing inaccurate readings. Furthermore, the bubbles may cause the blood to spatter and form aerosols.

In our U.S. Pat. No. 5,065,765 we disclose a self-sealing blood collection tube. This tube has a plug at one end having at least one air passage therethrough which seals upon contact with the fluid. The fluid can be dispensed from the tube by pushing the plug into and through the tube. Although this device is quite useful, the volume of fluid which can be collected in a single tube is set by the dimensions of the tube and cannot later be changed by the user. Moreover, a special plunger device is required to dispense fluid from this tube.

There is a need for a simple and inexpensive blood collection tube which can collect and dispense precise quantities of collected blood or other fluids.

SUMMARY OF THE INVENTION

We provide an automatic filling micropipette comprised of a small bore tube filled by capillary action. The interior surface of the tube is preferably a wettable thermoplastic, but may be glass or other wettable materials. One end of the tube is open and the opposite end of the tube is closed. A hole is made through the sidewall of the tube at a selected distance from the open end. The diameter of this hole is quite small, preferably 0.1 to 0.4 millimeters.

When the open end of the tube is placed against an incision or other liquid source the liquid will enter the tube by capillary action. As liquid enters the tube air within the tube will escape from the hole in the sidewall. When the liquid reaches the hole in the sidewall it will close that hole.

Consequently, there will be a volume of liquid and a volume of air within the tube. To dispense the liquid one squeezes the portion of the tube containing the air which forces liquid out the open end of the tube. Because the open end of the tube is significantly larger than the transverse hole in the tube, liquid should not escape through the hole in the sidewall.

In an alternative embodiment a plunger is provided within the tube for dispensing collected fluid.

Other objects and advantages of the present invention will become apparent from a description of certain present preferred embodiments shown in the drawings.

DESCRIPTION OF THE FIGURES

FIG. 1 is a perspective view of a first present preferred embodiment of our automatic filling micropipette.

FIG. 2 is a top plan view of the embodiment shown in FIG. 1.

FIG. 3 is a sectional view taken along the lines III—III of FIG. 2.

FIG. 4 is a top plan view of a second present preferred embodiment of the invention partially cut away at the sealed end.

FIG. 5 is a top plan view of a third present preferred embodiment of the invention.

FIG. 6 is a cross-sectional view of the third embodiment taken along the lines VI—VI of FIG. 5.

DESCRIPTION OF THE PREFERRED EMBODIMENTS

The first present preferred embodiment is shown in FIGS. 1 through 3. This micropipette 1 is comprised of a lower tube 2 having an open distal end 3, which can be 0.2 to 4 millimeters in diameter and preferably is from 0.9 to 1.6 millimeters in diameter. Fitted over the opposite end of the lower tube is an upper closed tube 4 having closed proximal end 5. The specimen collection tube 2 is preferably made of a wettable thermoplastic acrylonitrile barrier resin such as that, sold under the trademark BAREX, and a polyether block polyamide as is sold under the trademark PEBAX. Cellulose acetate propionate or butyrate are other water wettable thermoplastic polymers which may be used. The specimen collection tube could also be made from other plastics, glass, metals or ceramics. This tube may be rigid or flexible. One could also use polystyrene, polypropylene, acrylics, polyvinylchloride, polycarbonate and certain other poorly wettable polymers for the sample collection tube 2. If these naturally unwettable or hydrophobic materials are used it is necessary to pretreat them to cause the interior of the tube to be rendered wettable. These pretreatment processes are well known to those skilled in the art. They include the addition of polyethylene glycol or addition of surfactants to the molding resins for extrusion or molding of the tubes, subjecting the surfaces to plasma treatment so as to cause hydrophilic groups to be incorporated onto the surface of the molded parts, treatment of the molded part with a strong liquid oxidizing agent,or other comparable processes.

An aperture 6 is provided in the sidewall of the sample collection tube 2. The aperture 6 preferably is from 0.1 to 0.4 millimeters in diameter and is positioned a predetermined distance from the distal end 3 of the tube. The distance is selected so that the volume of fluid which can be contained between the distal end 3 and the aperture 6 is a known volume. Consequently, aperture 6 could be positioned at any point along the body of the sample collection tube 2. Tubing having a wall thickness of 0.50 millimeters, an inside diameter of 1.6 millimeters is suitable. Using such tubing we position the aperture 6 a distance of 5.2 millimeters from the distal end 3 to collect ten microliters of liquid by capillary action. We prefer to use a process wettable polycarbonate clear tube for sample collection tube 2.

Attached to the collection tube element is a flexible closed tube 4 which is used as a bulb to provide air pressure to expel liquid from the filled collection tube 2. This tube should be made of a flexible elastomer such as PEBAX 6333 elastomer available from Atochem. Flexible closed tube 2 may have an inside diameter of 2.5 millimeters with a 1.5 millimeter wall thickness.

As can be seen from FIG. 3 when the collection tube is placed near an incision or other liquid source, liquid will enter the distal end 3 of the tube. As the liquid enters the tube air will be expelled through aperture 6. When the liquid reaches aperture 6 it will close off the aperture thereby preventing any further expulsion of air. As a consequence no further liquid will enter the tube. Aperture 6 is preferably 0.1 to 0.4 millimeters in diameter. Consequently, that the surface tension between the liquid and the sidewalls of the aperture will be sufficient to close the aperture.

When one wishes to expel the liquid from the collection tube 2 the user merely squeezes the flexible upper tube 4. That forces air to push the liquid from the tube through distal end 3. Because the opening of distal end 3 is so much greater than aperture 6, the collected liquid will flow through the distal end of the tube 3 rather than escape through aperture 6.

In FIG. 4 we show a second preferred embodiment of our micropipette 10. This embodiment consists of a single flexible tube 12. The tube is open at its distal end 13 and closed at its proximal end 15. Aperture 16 is provided in the sidewall of the tube at a selected distance from the distal end. This embodiment can be made from any flexible wettable material. One suitable material is PEBAX 6333 polyether block polyamide. We have found that a tube 51 millimeters (or two inches long) having an inside diameter of 1.6 millimeters and wall thickness of 0.15 millimeters is satisfactory. Using such tube with the aperture 16 positioned 6.2 millimeters from the distal end 13 we can collect 12 microliters of liquid by capillary action.

A third present preferred embodiment is illustrated in FIGS. 5 and 6. This embodiment 20 is configured much like a syringe. We provide a fluid sample collection tube 22 having a generally cylindrical main body portion 24 and tapered nose 27. A transition 25 is provided between the tapered nose 27 and cylindrical body 24. The nose terminates at open distal end 23. A collar 28 is provided at the proximal end of the collection tube 22. We also provide an aperture 26 in the cylindrical portion 24 of the main tubular body 22. A plunger or piston 30 is fitted within the main tubular body 22. The plunger is comprised of a tapered nose 36, main body portion 34 and seat 32. If desired calibration markings 38 can be provided on the plunger.

To use the embodiment of FIGS. 5 and 6 the plunger 30 is positioned within the main tubular body 22 so as not to block aperture 26. When the device 20 is placed near a finger puncture or other liquid source, liquid will enter the collection tube 22 by capillary action. When the liquid reaches aperture 26 it will close off the aperture thereby preventing additional liquid from entering the device. The quantity of liquid which can be collected will depend upon both the volume of the nose portion 27 and that portion of the tubular body 24 between the nose and aperture 26. It should be apparent from FIG. 6 that a portion of that volume may be filled by the nose 36 of plunger 30. This nose can be sized and configured so that a desired volume will be present when the nose is positioned as in FIG. 6. It should be apparent that by drawing the plunger from the main tubular body additional volume can be made available to receive collected liquid.

The micropipette shown in the drawings can collect and dispense various quantities of water. Ten microliters of liquid can be easily collected and dispensed when the aperture is precisely positioned. The accuracy of the dispensing of the liquid will depend upon the tolerance limits and control of the tubing diameter between the admittance orifice at the distal end and the aperture through the sidewall as well as the distance between that aperture and the distal end.

Because the present invention relies upon capillary action rather than suction to collect liquid it is unlikely that air bubbles will be entrained in the collected liquid. Consequently, this device is much superior to eye droppers and pipettes which utilize a flexible bulb at the proximate end.

The embodiment of FIG. 3 can be made from a variety of materials. We have made suitable devices using BAREX acrylonitrile barrier resins and cellulose acetate propionate.

Although we have shown and described certain present preferred embodiments of our micropipette it should be understood that the invention is not limited thereto, but may be variously embodied within the scope of the following claims.

We claim:

1. An automatic filling micropipette comprising a tubular body having a closed end, an open end having an opening of a selected diameter and a sidewall extending therebetween, the tubular body having an inner diameter sized to permit liquid to flow into the tubular body by capillary action, at least a portion of the tubular body being flexible, and the sidewall having an aperture therethrough, the aperture having a diameter smaller than the diameter of the open end and being positioned to allow air to escape from the tubular body only until a volume of liquid has entered the tubular body.

2. The automatic filling micropipette of claim 1 wherein the tubular body is comprised of:

a. a sample collection tube containing the open end and the aperture; and b. a flexible hollow member attached to the sample collection tube in a manner so that compression of the flexible member will cause air contained within the flexible hollow member to be expelled from the flexible member into the sample collection tube.

3. The automatic filling micropipette of claim 2 wherein the sample collection tube is comprised of a wettable thermoplastic.

4. The automatic filling micropipette of claim 3 wherein the wettable thermoplastic is selected from the group of thermoplastics consisting of acrylonitrile barrier resins, polyether block polyamides, cellulose acetate propionate, and butyrate.

5. The automatic filling micropipette of claim 2 wherein the sample collection tube is comprised of one of a wettable plastic, glass, metal, and a ceramic.

6. The automatic filling micropipette of claim 2 wherein the sample collection tube is comprised of a polymer which has been treated in a manner to render the polymer wettable.

7. The automatic filling micropipette of claim 2 wherein the sample collection tube has an interior surface which has been treated to render the interior surface wettable.

8. The automatic filling micropipette of claim 2 wherein the diameter of the aperture is from 0.1 to 0.4 millimeters and the diameter of the open end is from 0.2 to 4 millimeters.

9. An automatic filling micropipette comprising a. a sample collection tube having an open distal end of a selected diameter, an open proximal end, and a sidewall extending therebetween, the sample collection tube having an inner diameter sized to permit liquid to flow into the sample collection tube by capillary action, and the sidewall having an aperture therethrough, the aperture having a diameter smaller than the diameter of the distal end and being positioned to allow air to escape from the tubular body only until a volume of liquid has entered the tubular body; and b. a piston inserted into the sample collection tube through the proximal end.

10. The automatic filling micropipette of claim 9 wherein the distal end of the sample collection tube is frustro-conical.

11. The automatic filling micropipette of claim 9 wherein the piston has a tapered nose at one end which nose is within the sample collection tube.

12. The automatic filling micropipette of claim 9 wherein the sample collection tube is comprised of a wettable thermoplastic.

13. The automatic filling micropipette of claim 12 wherein the wettable thermoplastic is selected from the group of thermoplastics consisting of acrylonitrile barrier resins, polyether block polyamides, cellulose acetate propionate, and butyrate.

14. The automatic filling micropipette of claim 9 wherein the sample collection tube is comprised of one of a wettable plastic, glass, metal, and a ceramic.

15. The automatic filling micropipette of claim 9 wherein the sample collection tube is comprised of a polymer which has been treated in a manner to render the polymer wettable.

16. The automatic filling micropipette of claim 9 wherein the sample collection tube has an interior surface which has been treated to render the interior surface wettable.

17. The automatic filling micropipette of claim 9 wherein the diameter of the aperture is from 0.1 to 0.4 millimeters and the diameter of the open end is from 0.2 to 4 millimeters.

18. The automatic filling device of claim 9 also comprising calibration markings on the plunger.

* * * * *